US010539896B1

(12) United States Patent
Nosella et al.

(10) Patent No.: US 10,539,896 B1
(45) Date of Patent: Jan. 21, 2020

(54) NON-BISPHENOL-A EMULSION AGGREGATION TONER AND PROCESS

(71) Applicant: Xerox Corporation, Norwalk, CT (US)

(72) Inventors: Kimberly D. Nosella, Mississauga (CA); Guerino G. Sacripante, Oakville (CA); Edward G. Zwartz, Mississauga (CA); Michael Steven Hawkins, Cambridge (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/247,245

(22) Filed: Jan. 14, 2019

(51) Int. Cl.
*G03G 9/08* (2006.01)
*G03G 9/087* (2006.01)
*G03G 9/093* (2006.01)

(52) U.S. Cl.
CPC ..... *G03G 9/08755* (2013.01); *G03G 9/08791* (2013.01); *G03G 9/09321* (2013.01); *G03G 9/09364* (2013.01); *G03G 9/09371* (2013.01); *G03G 9/09392* (2013.01)

(58) Field of Classification Search
CPC ..... G03G 9/08755; G03G 9/08791
USPC ..... 430/109.4
See application file for complete search history.

(56) References Cited

U.S. PATENT DOCUMENTS

| | | | | |
|---|---|---|---|---|
| 3,590,000 | A | 6/1971 | Palermiti et al. | |
| 3,655,374 | A | 4/1972 | Palermiti et al. | |
| 3,720,617 | A | 3/1973 | Chatterji et al. | |
| 3,944,493 | A | 3/1976 | Jadwin et al. | |
| 3,983,045 | A | 9/1976 | Jugle et al. | |
| 4,007,293 | A | 2/1977 | Mincer et al. | |
| 4,079,014 | A | 3/1978 | Burness et al. | |
| 4,298,672 | A | 11/1981 | Lu | |
| 4,338,390 | A | 7/1982 | Lu | |
| 4,394,430 | A | 7/1983 | Jadwin et al. | |
| 4,560,635 | A | 12/1985 | Hoffend et al. | |
| 5,290,654 | A | 3/1994 | Sacripante et al. | |
| 5,302,486 | A | 4/1994 | Patel et al. | |
| 6,004,714 | A | 12/1999 | Ciccarelli et al. | |
| 6,190,815 | B1 | 2/2001 | Ciccarelli et al. | |
| 7,291,437 | B2 | 11/2007 | Grillo et al. | |
| 7,736,831 | B2 | 6/2010 | Lai et al. | |
| 7,910,275 | B2 | 3/2011 | Patel et al. | |
| 9,791,795 | B2 | 10/2017 | Zhou et al. | |
| 9,822,217 | B2 | 11/2017 | Faucher et al. | |
| 9,864,291 | B1 | 1/2018 | Veregin et al. | |
| 9,891,544 | B2 | 2/2018 | Veregin et al. | |
| 9,971,265 | B1 * | 5/2018 | Sacripante ..... | G03G 9/09371 |
| 2011/0250536 | A1 | 10/2011 | Veregin et al. | |
| 2018/0210358 | A1 * | 7/2018 | Sacripante ..... | G03G 9/08755 |

* cited by examiner

*Primary Examiner* — Mark A Chapman
(74) *Attorney, Agent, or Firm* — Marylou J. Lavoie, Esq.

(57) ABSTRACT

A toner composition including an amorphous polyester resin; a crystalline polyester resin; a styrene acrylate copolymer; an optional wax; and an optional colorant; wherein the amorphous polyester resin comprises a rosin monomer content of from about 10 to about 25 percent rosin monomer based upon the total amount of monomer comprising the amorphous polyester resin. A toner composition including a core and at least one shell disposed thereover. A toner process including contacting an amorphous polyester resin; a crystalline polyester resin; a styrene acrylate copolymer; an optional wax; an optional colorant; and an optional aggregating agent; wherein the amorphous polyester resin comprises a rosin monomer content of from about 10 to about 25 percent rosin monomer heating to form aggregated toner particles; optionally, adding a shell resin to the aggregated toner particles, heating to coalesce the particles; and recovering the toner particles.

19 Claims, No Drawings

NON-BISPHENOL-A EMULSION AGGREGATION TONER AND PROCESS

BACKGROUND

Disclosed herein is a toner composition comprising an amorphous polyester resin; a crystalline polyester resin; a styrene acrylate copolymer; an optional wax; and an optional colorant; wherein the amorphous polyester resin comprises a rosin monomer content of from about 10 to about 25 percent rosin monomer based upon the total amount of monomer comprising the amorphous polyester resin. In embodiments, the toner is free of bisphenol A.

Further disclosed is a toner composition comprising a core; at least one shell disposed thereover; wherein the core comprises at least one amorphous polyester resin, at least one crystalline polyester resin; at least one styrene acrylate copolymer, an optional wax, and an optional colorant; wherein the shell comprises at least one styrene acrylate copolymer and an optional wax; and wherein the amorphous polyester resin comprises a rosin monomer content of from about 10 to about 25 percent rosin monomer based upon the total amount of monomer comprising the amorphous polyester resin.

Further disclosed is a toner process comprising contacting an amorphous polyester resin; a crystalline polyester resin; a styrene acrylate copolymer; an optional wax; an optional colorant; and an optional aggregating agent; wherein the amorphous polyester resin comprises a rosin monomer content of from about 10 to about 25 percent rosin monomer based upon the total amount of monomer comprising the amorphous polyester resin; heating to form aggregated toner particles; optionally, adding a shell resin to the aggregated toner particles, and heating to a further elevated temperature to coalesce the particles; and recovering the toner particles.

The vast majority of polymeric materials are based on extracting and processing fossil fuels, a limited resource, potentially resulting in accumulation of non-degradable materials in the environment. Recently, the USDA proposed that all toner/ink have a bio-derived (or sustainable) content of at least 20%. Bio-derived resins are being developed but commercial integration of such reagents into toner and ink remains to be resolved. The terms, "bio-derived resin," "bio-based resin," and, "sustainable resin," are used interchangeably herein and are meant to indicate that the resin or polyester resin is derived from or is obtained from materials or reagents that are obtained from natural sources and are biodegradable, in contrast to materials or monomers obtained from petrochemicals or petroleum-based sources.

Many toners are comprised of at least one amorphous resin. These resins are expensive and are derived from a bisphenol-A based polyester resin. There are customer needs for non-bisphenol-A based toners for applications such as food packaging and there is also a need for lower cost sustainable resins. Additionally, in the future, there may be government procurement requirements for non-bisphenol-A based toners as well as a sustainable requirement of as much as 20% sustainable content by weight of toner.

There are currently known toners comprising crystalline and amorphous polyester. U.S. Pat. No. 9,891,544, which is hereby incorporated by reference herein in its entirety, describes in the abstract thereof toner compositions with toner particles having a core-shell type structure, where the core comprises a first resin comprising a styrene-acrylate copolymer and an amorphous polyester resin, and the shell comprises a second resin comprising beta-carboxyethyl acrylate (β-CEA) in an amount of from about 0.05 pph to about 2.5 pph by weight of the second resin.

U.S. Pat. No. 9,864,291, which is hereby incorporated by reference herein in its entirety, describes in the abstract thereof a hybrid toner includes a core having at least one amorphous polyester resin and at least one crystalline polyester resin, and at least one styrene/acrylate resin, a shell comprising at least one styrene/acrylate resin, at least one wax, and optionally a pigment dispersion, the first modulated differential calorimetry scan of the hybrid toner shows at least two melting point peaks below about 80° C., and the difference between the two melting point peaks is less than or equal to about 15° C.

While these toners are suitable for their intended purposes, the amorphous polyesters utilized in the core comprise bisphenol-A based resins. These toners are not sufficient for those applications wherein non-bisphenol-A based toners are desired or required such as, for example, food packaging.

U.S. Pat. No. 9,791,795, which is hereby incorporated by reference herein in its entirety, describes sustainable resins comprising a rosin or a derivative thereof and lower molecular weight crystalline polyester (CPE) resins which are combined and used in a toner to achieve resin compatibility resulting in lower fixing temperature and higher blocking temperature. These non-bisphenol-A based polyester toner resins include sustainable amorphous rosin based polyester resin.

While certain sustainable resins may be suitable for their intended purpose, the cost of the overall sustainable resin can be as much as 15 to 20 percent higher than comparable non-sustainable resin toners.

Currently available toner compositions and processes are suitable for their intended purposes. However a need remains for improved toner compositions and processes. Further, a need remains for a lower cost non-bisphenol-A based toner suitable for digital packaging applications such as food or pharmaceutical packaging.

The appropriate components and process aspects of the each of the foregoing U. S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a toner composition comprising an amorphous polyester resin; a crystalline polyester resin; a styrene acrylate copolymer; an optional wax; and an optional colorant; wherein the amorphous polyester resin comprises a rosin monomer content of from about 10 to about 25 percent rosin monomer based upon the total amount of monomer comprising the amorphous polyester resin.

Also described is a toner composition comprising a core; at least one shell disposed thereover; wherein the core comprises at least one amorphous polyester resin, at least one crystalline polyester resin; at least one styrene acrylate copolymer, an optional wax, and an optional colorant; wherein the shell comprises at least one styrene acrylate copolymer and an optional wax; and wherein the amorphous polyester resin comprises a rosin monomer content of from about 10 to about 25 percent rosin monomer based upon the total amount of monomer comprising the amorphous polyester resin.

Also described is a toner process comprising contacting an amorphous polyester resin; a crystalline polyester resin; a styrene acrylate copolymer; an optional wax; an optional colorant; and an optional aggregating agent; wherein the amorphous polyester resin comprises a rosin monomer content of from about 10 to about 25 percent rosin monomer based upon the total amount of monomer comprising the amorphous polyester resin; heating to form aggregated toner particles; optionally, adding a shell resin to the aggregated toner particles, and heating to a further elevated temperature to coalesce the particles; and recovering the toner particles.

DETAILED DESCRIPTION

The present disclosure provides a very low cost, non-bisphenol-A, sustainable toner composition and process that can provide production savings, in embodiments, of up to about U.S. $1, kg or greater of toner versus currently known toner.

In embodiments, provided herein is a toner composition comprising an amorphous polyester resin; a crystalline polyester resin; a styrene acrylate copolymer; an optional wax; and an optional colorant; wherein the amorphous polyester resin comprises a rosin monomer content of from about 10 to about 25 percent rosin monomer based upon the total amount of monomer comprising the amorphous polyester resin.

In embodiments, the amorphous polyester resin comprises an amorphous sustainable rosin based polyester resin.

Glycerine carbonate ($C_4H_6O_4$) can be reacted with an organic acid, such as a rosin acid, to make alcohols, such as rosin-diols (denoted below as I and II), as well as bis-rosin alcohols (identified as III and IV below) and a rosin-carbonate (identified as V below), as depicted in the following scheme.

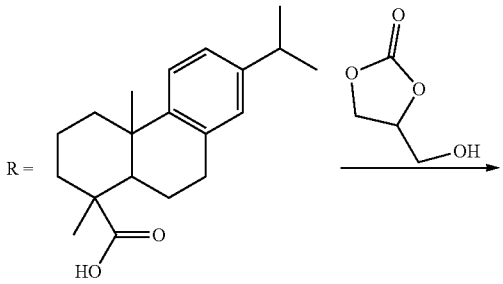

-continued

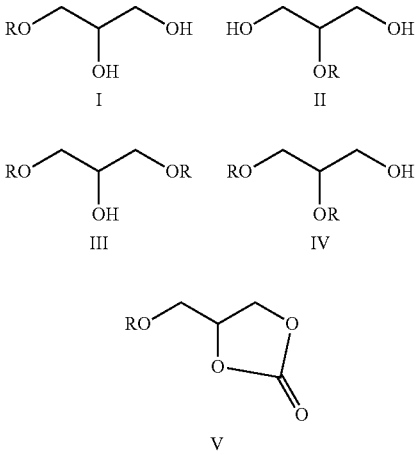

The resulting mixture of rosin adducts I through V can vary in relative amounts depending on, for example, reaction conditions, stoichiometry of the starting rosin acid, glycerine carbonate amount and catalyst. In an embodiment, of from about 1.0 to about 1.2 mole equivalents of rosin acid are reacted with from about 1.2 to about 3 mole equivalents of glycerine carbonate and a catalyst, such as, tetralkyl ammonium halide, at a temperature of from about 140° C. to about 170° C. The excess glycerine carbonate can be distilled from the reaction mixture, if desired.

In embodiments, the rosin monomer content of the amorphous polyester resin herein comprises a mixture of a rosin-diol, a bis-rosin alcohol, and a rosin-carbonate. In embodiments, the rosin monomer content of the amorphous polyester resin comprises at least one of rosin adducts I-V.

The relative ratio of rosin-diol (I and II) amount to bis-rosin alcohol (III and IV) amount can vary of from about 3:1 to about 20:1 when excess glycerine carbonate is utilized as more rosin diol is produced.

Rosin adducts I through V then can be reacted with known polyester-forming monomers, for example, terephthalic acid or succinic acid, and other polyols, such as butanediol or 1,2-propylene glycol, in a polycondensation reaction to form a resin. Rosin-diols I and II, as well as rosin-carbonate V polymerize with polyacids to form the backbone of a polyester resin, and bis-rosin alcohols Ill and IV can form terminal groups (moieties) of a polyester resin, as depicted, for example, in the following structure

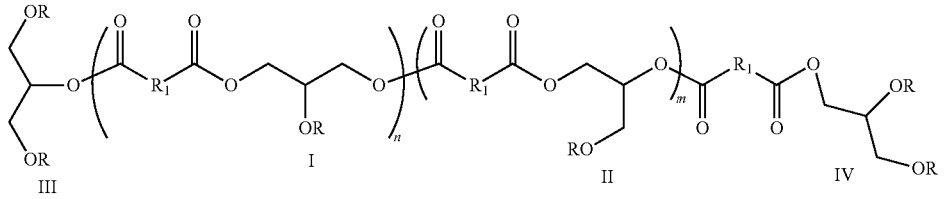

wherein R is a rosin moiety, $R_1$ is an alkyl (or alkylene) or aryl moiety, segments I to IV represent the rosin adduct moieties, and n and m represent the number of individual, single acid/alcohol ester units and each of n and m is from about 10 to about 10,000.

Certain embodiments comprise the following reaction scheme

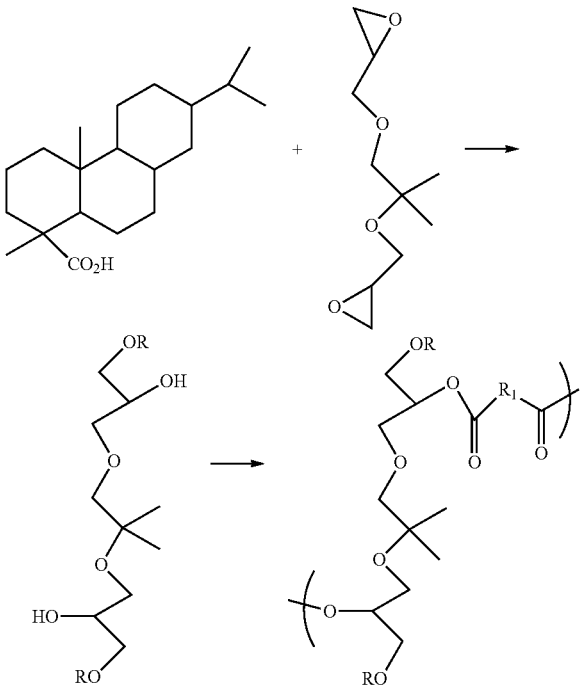

wherein R is rosin and $R_1$ is arylene $CH_2$—$CH_2$ (8:1 ratio).

The ratio of rosin-diols to bis-rosin alcohols influences polydispersity of a resin. If the ratio of rosin-diols to bis-rosin alcohols is high, such as, from about 10:1, from about 15:1, from about 20:1 or more, polydispersity of the polymer, as measured as the ratio of weight average (Mw) to number average (Mn) molecular weight, is relatively low, such as, from about 2 to 4. However, if the ratio of rosin-diols to bis-rosin alcohols is lower, such as, from about 6:1, from about 5:1, from about 4:1 or lower, polydispersity of the polymer is relatively high, such as, from 5 to about 40.

To obtain a toner resin with optimal fusing performance, including broad fusing latitude, a toner comprises relative high polydispersity, such as, at least about 5, at least about 7.5, at least about 10, up to about 15, up to about 17.5, up to about 20 or more, which can be obtained with rosin adduct mixtures comprising lower amounts of rosin diols, which can be obtained using lower amounts of, for example, glycerol carbonate when reacted with a rosin acid to form said adducts.

In embodiments, processes to obtain a lower cost sustainable resin, where rosin adducts for producing resin reagents are made from glycerine carbonate and rosin acid are disclosed. In embodiments, to optimize compatibility of a rosin-based resin with a lower cost crystalline resin comprising smaller acid/ester and alcohol monomers, such as, for example, CPE 10:4, comprising 1,12-dodecanedioic acid and 1,4-butanediol, the amount of rosin-derived monomer in the bioresin is selected in an amount of from about 10 to about 25 percent rosin monomer, or from about 15 to about 20 percent rosin monomer, or from about 16 to about 18 percent rosin monomer, based upon the total amount of monomer comprising the amorphous polyester resin. In embodiments, this selection of amorphous polyester resin, comprising the rosin monomer, in the recited amounts, in combination with the crystalline polyester and styrene acrylate copolymer results in a toner having a compatibility (as revealed, for example, by degree of plasticization) that is not too high or too low, that achieves comparable charging, blocking, and fusing performance as prior known emulsion aggregation toners but with significantly reduced costs over prior comparable toners. To obtain polyester toners with low fixing temperatures and good blocking (cohesion) performance, a mixture of amorphous polyester resin and crystalline polyester resin is at least partially compatible as revealed, for example, by desired toner properties, such as, MFT and blocking performance. If the resulting toner is comprised of an amorphous, bio-based polyester resin and a crystalline resin that are too compatible, low fixing temperature is obtained, but that high resin compatibility results in too much plasticization resulting in poor blocking performance. Conversely, if a toner is comprised of an amorphous, bio-based polyester resin and a crystalline resin that are not too compatible or incompatible, good blocking performance will be obtained but fixing temperature will be higher. Therefore, to obtain both good blocking and low fixing temperature, an optimal compatibility between the amorphous and crystalline resins is desired.

Blocking performance can be determined practicing known methods. See, for example, U.S. Pat. No. 7,910,275, which is hereby incorporated by reference herein in its entirety. In embodiments, good blocking performance is achieved by a toner with a blocking temperature of at least about 50° C., at least about 53° C., at least about 54° C., at least about 55° C., at least about 56° C. or higher.

Minimum fixing temperature (MFT) can be determined practicing known methods. See, for example, U.S. Pat. No. 7,291,437, which is hereby incorporated by reference herein in its entirety. In embodiments, a good minimum fixing temperature is achieved by a toner with a fixing temperature of no more than about 125° C., no more than about 124° C., no more than about 123° C., no more than about 122° C. or lower.

Fusing (or fixing) latitude is the value obtained when minimum fixing temperature is subtracted from the hot offset temperature, as can be determined practicing known methods. See, for example, U.S. Pat. No. 7,291,437, which is hereby incorporated by reference herein in its entirety. In embodiments, a toner herein has a good latitude of at least about 80° C., at least about 82.5° C., at least about 85° C. or higher.

As used herein, a polymer is defined by the monomer(s) from which a polymer is made. Thus, for example, while in a polymer made using terephthalic acid as a monomer reagent, a terephthalic acid moiety per se no longer exists because of the ester condensation reaction, as used herein, that polymer is said to comprise a terephthalic acid. Thus, a biopolymer made by a one-pot process disclosed herein can comprise terephthalate/terephthalic acid; succinic acid; neopentyl glycol and dehydroabietic acid. That biopolymer also can be said to comprise neopentyl glycol as that diol is used with the terephthalate/terephthalic acid and succinic acid; can be said to comprise terephthalic acid as that monomer was used to make the biopolymer; can be said to be composed of or as comprising succinic acid as succinic acid is a monomer reagent of that polymer and so on. Hence, a polymer is defined herein based on one or more of the component monomer reagents, which provides a means to name a polymer of interest and to define and to identify a polymer of interest.

As used herein, "bio-based," or use of the prefix, "bio," refers to a reagent or to a product that is composed, in whole or in part, of a biological product, including plant, animal and marine materials, or derivatives thereof. Generally, a bio-based or biomaterial is, "biodegradable," that is, substantially or completely biodegradable, by substantially is meant greater than 50%, greater than 60%, greater than 70% or more of the material is degraded from the original molecule to another form by a biological or environmental mechanism, such as, action thereon by bacteria, animals, plants, light, temperature, oxygen and so on in a matter of days, matter of weeks, a year or more, but generally no longer than two years. A, "bio-resin," is a resin, such as, a polyester, which contains or is composed of a bio-based material in whole or in part, such as, a polyglycol, such as, polyethylene glycol and a dicarboxylic acid. Hence, the reagents can be a bio-polyacid and a bio-polyol. Such a reagent or resin can be described as, "sustainable," a synonym of bio-based.

In embodiments, a sustainable toner herein is one which replaces one or more limited, hazardous or petroleum-based reagents with one that is not, one that is sustainable or bio-based. One such less than desired reagent or compound found in commercial toner is bisphenol-A (BPA). BPA is considered a possible carcinogen, a compound that could precipitate a number of health issues and one believed to have estrogen activity. Hence, a sustainable toner herein comprises a toner that replaces some or all BPA-containing reagents with a bio-based reagent, with minimal or no loss of toner performance Hence, when BPA amount is reduced or removed altogether and replaced with one or more bio-reagents, such a sustainable toner is one which is BPA-free, contains no or 0% BPA and other functionally equivalent phrases and terms. In specific embodiments, the toner composition herein is free of bisphenol-A.

As used herein, "plasticize," including grammatical variations thereof, refers to a change in the thermal and mechanical properties of a given polymer which involves: (a) lowering of rigidity at room temperature (RT); (b) lowering of temperature at which substantial deformations can occur with not too large forces; (c) increase of the elongation to break at RT; and/or (d) increase of toughness (impact strength) down to the lowest temperature of serviceability. For example, a plasticizer lowers Tg of a polymer or negatively impacts blocking (cohesion) of a toner in which a plasticizer is present.

As used herein a "rosin," or "rosin adduct," or grammatical forms thereof, is intended to encompass a rosin, a rosin acid, a rosin ester, a rosin-diol, a rosin carbonate, a bis-rosin alcohol and so on, as well as a rosin derivative which is a rosin treated, for example, to comprise plural alcohol groups that can be used directly or indirectly as a monomer in a polyester polymer. Hence, a rosin derivative is a compound that is an acid, ester or alcohol that can be used to form a polyester polymer. As known in the art, rosin is a blend of at least eight monocarboxylic acids. Abietic acid can be a primary species and the other seven acids are isomers thereof. Because of the composition of a rosin, often the synonym, "rosin acid," is used to describe various rosin-derived products. As known, rosin is not a polymer but essentially a varying blend of the eight species of carboxylic acids. A rosin product includes, as known in the art, chemically modified rosin, such as, partially or fully hydrogenated rosin acids, partially or fully dimerized rosin acids, esterified rosin acids, functionalized rosin acids or combinations thereof. Rosin is available commercially in a number of forms, for example, as a rosin acid, as a rosin ester and so on. For example, rosin acids, rosin ester and dimerized rosin are available from Eastman Chemicals under the product lines, Poly-Pale™, Dymerex™, Staybelite-E™ Foral™ Ax-E, Lewisol™ and Pentalyn™; Arizona Chemicals under the product lines, Sylvalite™ and Sylvatac™; and Arakawa-USA under the product lines, Pensel and Hypal. In embodiments, rosin adducts are compounds I-V depicted hereinabove.

For example, a rosin acid or polyacidic forms thereof can be reacted with a polyol in a condensation reaction where the hydroxyl group of the alcohol combines at a carboxylic acid group of a rosin acid in a condensation reaction to form a joined molecule, a rosin ester, which is a, "single ester unit," composed of one alcohol monomer joined to one acid/ester monomer, which dimer can be viewed as a "monomer" or subunit when plural copies of that dimer are joined to form a polymer. Additional acid, ester alcohol and/or acid/alcohol monomers are added to the single ester unit to form a polyester polymer. Such a reaction is compatible with one-pot reaction conditions disclosed herein for producing a bioresin.

In embodiments, the reactions as disclosed herein result in, in part, abieticdiol, abietic monoglycerate, palustricdiol, palustric monoglycerate, dehydroabieticdiol, dehydroabietic monoglycerate, neoabieticdiol, neoabietic monoglycerate, levopimaricdiol, levopimaric monoglycerate, pimaricdiol, pimaric monoglycerate, sandaracopimaricdiol, sandaracopimaric monoglycerate, isopimaricdiol, isopimaric monoglycerate, hydrogenated abieticdiol, hydrogenated palustricdiol, hydrogenated dehydroabieticdiol, hydrogenated neoabieticdiol, hydrogenated levopimaricdiol, hydrogenated pimaricdiol, hydrogenated sandaracopimaricdiol, hydrogenated isopimaricdiol and so on.

A catalyst can be included in the reaction mixture to form an ester unit or a polyester polymer. Suitable catalysts include organoamines, such as, titanium triethanolaminate, ethylamine, butylamine and propylamine, arylamines, such as, imidazole, 2-methyl imidazole, pyridine and dimethylamino pyridine, organoammonium halides, such as, trimethylammonium chloride, triethylammonium chloride, tributylammonium chloride, trimethylammonium bromide, triethylammonium bromide, tributylammonium bromide, trimethylammonium iodide, triethylammonium iodide, tributylammonium iodide, tetraethylammonium chloride, tetraethyl ammonium bromide and tetraethylammonium iodide, organophosphines, such as, triphenylphosphine, organophosphonium halides, such as, tetraethylphosphonium chloride, tetraethylphosphonium bromide, tetrabutyl phosphonium chloride, tetrabutyl phosphonium bromide, tetrabutyl phosphonium iodide and so on.

The reaction can be conducted at an elevated temperature, such as, from about 130° C. to about 200° C., or from about 145° C. to about 175° C., or from about 150° C. to about 170° C. and so on, although temperatures outside of those ranges can be used as a design choice.

The toner compositions herein contain at least one amorphous polyester comprising at least one rosin monomer as described herein. In embodiments, the amorphous polyester resin comprises a rosin monomer content of from about 10 to about 25 percent rosin monomer, or from about 15 to about 20 percent rosin monomer, or from about 16 to about 18 percent rosin monomer, by weight, based upon the total weight of monomer comprising the amorphous polyester resin.

In embodiments, the toner composition herein is prepared by an emulsion aggregation process. In certain embodiments, the toner comprises a core-shell toner comprising a core having at least one shell disposed thereover. The amorphous polyester can be present in the core, the shell, or both. In specific embodiments, the amorphous polyester is present in the core and the shell is free of (does not contain) amorphous polyester.

The amorphous polyester may be formed by reacting a diol with a diacid in the present of an optional catalyst. In addition to the rosin monomer content described herein, the amorphous polyester may be formed using diacids or diesters including vinyl diacids or vinyl diesters used for the preparation of amorphous polyesters including dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof.

In embodiments, polyacids or polyesters, which may be a bioacid or a bioester, that can be used for preparing an amorphous polyester resin include terephthalic acid, phthalic acid, isophthalic acid, fumaric acid, trimellitic acid, diethyl fumarate, dimethyl itaconate, cis-1,4-diacetoxy-2-butene, dimethyl fumarate, diethyl maleate, maleic acid, succinic acid, itaconic acid, succinic acid, cyclohexanoic acid, succinic anhydride, dodecylsuccinic acid, dodecylsuccinic anhydride, glutaric acid, glutaric anhydride, adipic acid, pimelic acid, suberic acid, azelaic acid, dodecanedioic acid, dimethyl naphthalenedicarboxylate, dimethyl terephthalate, diethyl terephthalate, dimethylisophthalate, diethylisophthalate, dimethylphthalate, phthalic anhydride, diethylphthalate, dimethylsuccinate, naphthalene dicarboxylic acid, dimer diacid, dimethylfumarate, dimethylmaleate, dimethylglutarate, dimethyladipate, dimethyl dodecylsuccinate, and combinations thereof.

The organic diacid or diester may be present, in embodiments, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. In specific embodiments, the present toner composition is free of bisphenol A monomer.

In embodiments, polyols which may be used in generating an amorphous polyester resin include rosin-diols, bis-rosin alcohols, 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, dodecanediol, 1,4-cyclohexanedimethanol, 1,3-cyclohexanedimethanol, heptanediol, xylenedimethanol, cyclohexanediol, diethylene glycol, bis(2-hydroxyethyl) oxide, dipropylene glycol, dibutylene glycol and combinations thereof.

The amount of organic diol selected can vary, and may be present, for example, in an amount from about 40 to about 60 mole percent of the resin, or, from about 42 to about 55 mole percent of the resin, or from about 45 to about 53 mole percent of the resin. As with the diacid or diester, the diol content is adjusted such that the amorphous polyester comprises a rosin monomer content of from about 10 to about 25 percent rosin monomer, or from about 15 to about 20 percent rosin monomer, or from about 16 to about 18 percent rosin monomer, by weight, based upon the total weight of monomer comprising the amorphous polyester resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be used in any suitable or desired amount, such as, in embodiments, from about 0.01 mole percent to about 5 mole percent based on the starting diacid or diester used to generate the polyester resin.

The sustainable amorphous resin may be present in the toner in any suitable or desired amount, in embodiments, in an amount of from about 5 to about 80% by weight of the toner components, or in an amount of from about 20 to about 80% by weight of the toner components, or from about 25 to about 60% by weight of the toner components, or from about 35 to about 50% by weight of the toner components. In certain embodiments, the sustainable amorphous resin is present in an amount of from about 5 to about 45% by weight, based upon the total weight of the toner components.

For forming a crystalline polyester resin, suitable polyols include aliphatic polyols with from about 2 to about 12 carbon atoms, with no more than 10 methylene groups, such as, 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like. The polyol may be selected in any suitable or desired amount, in embodiments, in an amount from about 40 to about 60 mol %.

Examples of polyacid or polyester reagents for preparing a crystalline resin include reagents of from about 2 to about 12 carbon atoms, with no more than 10 methylene groups, such as, oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, 1,10 decanedioic acid, 1,11-undecanedioic acid, 1,9-nonanedioic acid, 1,12-dodecanedioic acid, terephthalic acid, naphthalene-2,6-dicarboxylic acid, naphthalene-2,7-dicarboxylic acid, cyclohexane dicarboxylic acid (sometimes referred to herein, in embodiments, as cyclohexanedioic acid), malonic acid and mesaconic acid, a polyester or anhydride thereof. The polyacid may be selected in any suitable or desired amount, in embodiments, in an amount from about 40 to about 60 mol %.

Specific crystalline resins that can be used include poly (ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(1,6-hexylene-decanoate), poly(1,6-hexylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate) and copoly(2,2-dimethylpropane-1,3-diol-decanoate)-copoly(ethylene-adipate).

The designation, "CX:CY," "CX:Y," "X:Y," and forms thereof as used herein describe crystalline resins, wherein C is carbon, X is a positive, non-zero integer identifying the number of methylene groups of the acid/ester monomer used to produce the CPE and Y is a positive, non-zero integer identifying the number of methylene groups of the alcohol monomer used to produce the CPE. Thus, for example, C10 can represent, for example, a dodecanedioic acid and C6 can represent, for example, a hexanediol. X and Y each is 10 or lower. In embodiments, the sum of X and Y is 16 or lower. In certain embodiments, the sum and X and Y is 14 or lower.

In embodiments, the crystalline polyester resin comprises an acid monomer comprising at least one methylene group and an alcohol monomer comprising at least one methylene group, wherein said acid and alcohol monomers together comprise 14 or fewer methylene groups.

In embodiments the crystalline resin is CPE C10:4 resin. In certain embodiments, the crystalline resin comprises 1,12-dodecanedioic acid and 1,4-butandiol monomers.

A suitable CPE resin may include a resin of 1,12-dodecanedioic acid and 1,4-butanediol monomers, where such CPE resin is denoted a C10:4, where the integers represent the number of methylene units (e.g., C10, ten methylene units and C4, four methylene units) in the reagents, single ester unit and polyester polymer.

The crystalline resin may be present in any suitable or desired amount, in embodiments, in an amount of from about 1 to about 25% by weight of the toner components, or from about 2 to about 20% by weight of the toner components, or from about 5 to about 20% by weight of the toner components, or from about 5 to about 12% by weight of the toner components, or from about 3 to about 15% by weight of the toner components.

In embodiments, the crystalline resin can possess various melting points of, for example, from about 30° C. to about 120° C., or from about 50° C. to about 90° C., or from about 60° C. to about 80° C. The crystalline resin may have a number average molecular weight (Mn), as measured by gel permeation chromatography (GPC) of, for example, from about 1,000 to about 50,000, from about 2,000 to about 25,000, and a weight average molecular weight (Mw) of, for example, from about 2,000 to about 100,000, from about 3,000 to about 80,000, as determined by GPC. The molecular weight distribution (Mw/Mn or polydispersity) of the crystalline resin may be, for example, from 5 to about 40, from about 6 to about 35, or outside of those ranges and at least greater than 5.

Branching agents can be used and include, for example, a multivalent polyacid, such as, 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, 1,2,7,8-octanetetracarboxylic acid, acid anhydrides thereof, lower alkyl esters thereof and multivalent polyols, such as, glycerine, pentaerythritol, glycerine carbonate, trimethylopropane and so on. A branching agent can be used in an amount from about 0.01 to about 10 mole % of the resin, although amounts outside of that range can be used.

The resins of the present embodiments can be prepared by any suitable or desired process. For example, as known in the art, the polyacid/polyester and polyol reagents, including in embodiments dipropylene glycol, are mixed together, optionally with a catalyst, and incubated at an elevated temperature, such as, from about 200° C. or more, from about 210° C. or more, from about 220° C. or more, and so on, but sometimes not more than about 230° C., not more than about 235° C. or more, although temperatures outside of those ranges can be used to enable esterification to proceed to equilibrium, which generally yields water or an alcohol as a byproduct, such as, methanol, arising from forming the ester bonds in esterification reactions. Temperatures above 230° C. may result in volatilization of some reagents, for example, dipropylene glycol, and removal of that reagent can moderate a condensation reaction, and hence, the acid value (AV) of the developing polymer. The reaction can be conducted under vacuum to promote polymerization and to facilitate removal of any volatilized reagents. The reaction can be conducted under an inert atmosphere, such as, nitrogen gas, again, which can facilitate removal of any volatilized reagents.

To provide latitude in manipulating reaction conditions to obtain resins with the desired softening temperature (Ts) and AV, a stoichiometric imbalance of polyacid to polyol can be utilized, and generally, the polyacid is in excess unless the polyol is volatile and distills from the mixture. An excess of a reagent can be determined in terms of stoichiometric excess of alcohol to acid in the reaction mixture. That can be assessed in terms of molar equivalents such that the molar ratio of alcohol:acid is greater than 0.5:0.5, for example, from about 0.505 to about 0.495, from about 0.51 to about 0.49, from about 0.515 to about 0.485, from about 0.52 to about 0.48 or greater amounts of alcohol relative to acid. When another alcohol is included in the reaction, the molar equivalents of the alcohols are summed for the above calculation.

Accordingly, disclosed herein is one-pot reaction for producing a bio-polyester or sustainable resin suitable for use in an imaging toner. A bio-polyester resin is produced and processed to form a polymer reagent, which can be dried and formed into flowable particles, such as, a pellet, a powder and the like. The polymer reagent then can be incorporated with, for example, other reagents suitable for making a toner particle, such as, a colorant and/or a wax, and processed in a known manner to produce toner particles.

The toner compositions herein further include a styrene acrylate copolymer. For toner embodiments comprising a core-shell configuration, the styrene acrylate copolymer can be present in the core, the shell, or both the core and the shell. In certain embodiments, a toner herein includes a toner comprising a core; at least one shell disposed thereover; wherein the core comprises at least one amorphous polyester resin, at least one crystalline polyester resin; at least one styrene acrylate copolymer, an optional wax, and an optional colorant; wherein the shell comprises at least one styrene acrylate copolymer and an optional wax; and wherein the amorphous polyester resin comprises a rosin monomer content of from about 10 to about 25 percent rosin monomer based upon the total amount of monomer comprising the amorphous polyester resin. In embodiments, the toner comprises a core and a shell disposed thereover, wherein the shell consists of a styrene acrylate copolymer. In embodiments, the shell is free of wax. In embodiments, the toner comprises a first shell and a second shell. In certain embodiments, a toner herein comprises two or more shells disposed over a core, wherein at least one of the shells, in embodiments the outermost shell of the one or more shells, is free of wax. In certain embodiments, a toner herein comprises a core, a first shell disposed thereover, and a second shell disposed over the first shell, wherein the first shell comprises a styrene acrylate copolymer and a wax, and wherein the second shell consists of a styrene acrylate copolymer.

In addition to the amorphous sustainable resin and the crystalline polyester resin, the toners herein comprise a third resin, in embodiments a styrene acrylate copolymer. Any suitable or desired third resin can be selected. In embodiments, this resin is selected from poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methylmethacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butylacrylate), poly(styrene-butyl acrylate-acrylic acid), poly(styrene-butyl acrylate-methacrylic acid), poly(styrene-butyl acrylate-acrylonitrile), poly(styrene-butylacrylate-acrylonitrile-acrylic acid), poly(styrene-1,3-diene), poly(styrene-1,3-diene-acrylic acid), poly(styrene-1,3-diene-acrylonitrile-acrylic acid), poly(styrene-butadiene), poly(methylstyrene-butadiene), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl methacrylate-acrylic acid), poly(butyl methacrylate-butyl acrylate), poly-butyl methacrylate-acrylic acid), poly(acrylonitrile-butyl acrylate-acrylic acid), and mixtures thereof. The alkyl group in the aforementioned polymers may be any alkyl group, and in particular may be a C1-C12 alkyl group, for example including methyl, ethyl, propyl and butyl. As the aryl group, any aryl group known in the art may be used. In embodiments, the styrene acrylate copolymer is styrene butyl acrylate.

In embodiments, the toner comprises an amorphous sustainable polyester, a crystalline polyester, and styrene-alkyl acrylate, more particularly a styrene-butyl acrylate polymer such as a styrene-butyl acrylate polymer.

In embodiments, the styrene acrylate copolymer includes a styrene monomer and an acrylic monomer. In embodiments, the styrene acrylate copolymer further comprises at least one cross-linker.

In embodiments, the term "styrene monomer" refers to styrene per se, as well as styrene containing one or more substitutions, such as 3-chlorostyrene, 2,5-dichlorostyrene, 4-bromostyrene, 4-tert-butylstyrene, 4-methoxystyrene and the like.

In embodiments, the term "acrylic acid monomer" refers to acrylic acid, methacrylic acid, and -CEA. In embodiments, the term "acrylic ester monomer" refers to esters of acrylic acid and methacrylic acid. Acrylic ester monomers include, but are not limited to, butyl acrylate, butyl methacrylate, propyl acrylate, propyl methacrylate, ethyl acrylate, ethyl methacrylate, methyl acrylate and methyl methacrylate. In certain embodiments, the acrylic ester monomer is n-butyl acrylate.

The toner resins may have any suitable or desired particle size. In embodiments, the toner resins may have a mean particle size of from about 100 nanometers (nm) to about 250 nm, or from about 100 nm to about 140 nm, or from about 140 nm to about 200 nm, or from about 140 to about 250 nm.

In embodiments, the amorphous polyester resin is present in the toner in an amount of from about 10 to about 50 percent by weight, or from about 20 to about 45 percent by weight, or from about 35 to about 40 percent by weight, based on the total weight of the toner composition; the crystalline polyester resin is present in the toner an amount of from about 1 to about 25 percent by weight, or from about 5 to about 20 percent by weight, or from about 5 to about 15 percent by weight, based on the total weight of the toner composition; and the styrene acrylate copolymer is present in the toner an amount of from about 10 to about 50 percent by weight, or from about 20 to about 45 percent by weight, or from about 35 to about 40 percent by weight, based on the total weight of the toner composition.

In certain embodiments, the amorphous polyester resin is present in the toner in an amount of from about 20 to about 60 percent by weight based on the total weight of the toner composition; the crystalline polyester resin is present in an amount of from about 5 to about 20 percent by weight based on the total weight of the toner composition; and the styrene acrylate copolymer is present in an amount of from about 10 to about 40 percent by weight based on the total weight of the toner composition.

In further embodiments, the amorphous polyester resin is present in an amount of from about 35 to about 45 percent by weight based on the total weight of the toner composition; the crystalline polyester resin is present in an amount of from about 5 to about 12 percent by weight based on the total weight of the toner composition; and the styrene acrylate copolymer is present in an amount of from about 25 to about 30 percent by weight based on the total weight of the toner composition.

The toner compositions may include any suitable or desired colorant. Colorants, such as, cyan, magenta, yellow, red, orange, green, brown, blue, carbon black, or mixtures thereof can be used. Colorants can be used as water-based pigments.

In embodiments, the colorant is a pigment. In a specific embodiment, the colorant is a pigment selected from the group consisting of a magenta pigment, a cyan pigment, a yellow pigment, a black pigment, and mixtures and combinations thereof. The colorants may be employed in the toner preparation process in the form of dispersions which may be stabilized by synergists and dispersants.

Examples of suitable pigments include PALIOGEN® Violet 5100 (BASF); PALIOGEN® Violet 5890 (BASF); HELIOGEN® Green L8730 (BASF); LITHOL® Scarlet D3700 (BASF); SUNFAST® Blue 15:4 (Sun Chemical); Hostaperm® Blue B2G-D (Clariant); Hostaperm® Blue B4G (Clariant); SPECTRA® PAC C Blue 15:4 (Sun Chemical); Permanent Red P-F7RK; Hostaperm® Violet BL (Clariant); LITHOL® Scarlet 4440 (BASF); Bon Red C (Dominion Color Company); ORACET® Pink RF (BASF); PALIOGEN® Red 3871 K (BASF); SUNFAST® Blue 15:3 (Sun Chemical); PALIOGEN® Red 3340 (BASF); SUNFAST® Carbazole Violet 23 (Sun Chemical); LITHOL® Fast Scarlet L4300 (BASF); SUNBRITE® Yellow 17 (Sun Chemical); HELIOGEN® Blue L6900, L7020 (BASF); SUNBRITE® Yellow 74 (Sun Chemical); SPECTRA® PAC C Orange 16 (Sun Chemical); HELIOGEN® Blue K6902, K6910 (BASF); SUNFAST® Magenta 122 (Sun Chemical); HELIOGEN® Blue D6840, D7080 (BASF); Sudan Blue OS (BASF); NEOPEN® Blue FF4012 (BASF); PV Fast Blue B2GO1 (Clariant); IRGALITE® Blue GLO (BASF); PALIOGEN® Blue 6470 (BASF); Sudan Orange G (Aldrich); Sudan Orange 220 (BASF); PALIOGEN® Orange 3040 (BASF); PALIOGEN® Yellow 152, 1560 (BASF); LITHOL® Fast Yellow 0991 K (BASF); PALIOTOL® Yellow 1840 (BASF); NOVOPERM® Yellow FGL (Clariant); Ink Jet Yellow 4G VP2532 (Clariant); Toner Yellow HG (Clariant); Lumogen® Yellow D0790 (BASF); Suco-Yellow L1250 (BASF); Suco-Yellow D1355 (BASF); Suco Fast Yellow D1355, D1351 (BASF); HOSTAPERM® Pink E 02 (Clariant); Hansa Brilliant Yellow 5GX03 (Clariant); Permanent Yellow GRL 02 (Clariant); Permanent Rubine L6B 05 (Clariant); FANAL® Pink D4830 (BASF); CINQUASIA® Magenta (DU PONT); PALIOGEN® Black L0084 (BASF); Pigment Black K801 (BASF); and carbon blacks such as REGAL330™ (Cabot), Nipex 150 (Evonik) Carbon Black 5250 and Carbon Black 5750 (Columbia Chemical), and the like, as well as mixtures thereof.

The colorant may be used in any suitable or desired amount. In embodiments, colorant may be employed in an amount ranging from 0% (colorless or clear) to about 35% by weight of the toner particles on a solids basis.

In embodiments, the toner herein is a hyper-pigmented toner. In embodiments, "hyper-pigmented" means a toner having high pigment loading at low toner mass per unit area (TMA, calculated as known in the art), for example, such toners may have an increased in pigment loading of at least about 25%, at least about 35%, at least about 45%, at least about 55% or more by weight of the toner particle relative to non-hyper-pigmented toners (e.g., toners having carbon black pigment loadings of 6% or lower). In embodiments, a hyper-pigmented toner as used herein is any new formulation wherein the amount of pigment is at least about 1.2 times that found in a control, non-hyper-pigmented or known toner, in embodiments, at least about 1.3 times, at least about 1.4 times, at least about 1.5 times or more pigment as found in a control or known formulation.

In embodiments, "hyper-pigment," and grammatical forms thereof is meant to describe a toner or toner preparation that on printing and fusing the toner particles to the substrate to form an image of a 100% solid area single color patch, the thickness of that image is less than about 50%, less than about 60%, less than about 70% of a diameter of the toner particles, as provided, for example, in U.S. Pub. No. 20110250536, which is hereby incorporated by reference herein in its entirety.

In embodiments, "hyper-pigmented," means a toner having high pigment loading at low TMA than found in conventional toner, such as to provide a sufficient image reflection optical density (ODr) of greater than 1.40, greater than 1.45, greater than 1.50 when printed and fused on a substrate, such pigment loading chosen so that the ratio of TMA measured for a single color layer in $mg/cm^2$ divided by the volume diameter of the toner particle in microns, is less than about 0.075 to meet that required image density. The TMA may be about 0.55 $mg^2/cm$ or less, about 0.525 $mg^2/cm$ or less, about 0.5 $mg^2/cm$ or less or lower.

In embodiments, a toner herein comprises a hyper-pigmented toner wherein the colorant is a pigment present in the toner composition in an amount of from at least about 7 to about 50 percent by weight, or at least about 8 to about 50 percent by weight, or at least about 10 to about 50 percent by weight, based upon the total weight of the toner composition.

The toner herein may optionally contain a wax. The wax can be any suitable or desired wax. In embodiments, the wax can be either a single type of wax or a mixture of two or more different types of waxes (hereinafter identified as, "a wax"). When included, the wax may be present in any suitable or desired amount, in embodiments, in an amount of from about 1 to about 25 percent by weight, based upon the total weight of the toner composition.

Certain waxes that may be selected include waxes having, for example, an Mw of from about 500 to about 20,000.

Waxes that may be used include, for example, polyolefins, such as, polyethylene, polypropylene and polybutene waxes, such as, those that are commercially available, for example, POLYWAX™ polyethylene waxes from Baker Petrolite, wax emulsions available from Michaelman, Inc. or Daniels Products Co., EPOLENE N15™ which is commercially available from Eastman Chemical Products, Inc., VISCOL 550-P™, a low weight average molecular weight polypropylene available from Sanyo Kasei K.K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™, POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in embodiments.

An aggregating factor (or coagulant) may be used to facilitate growth of the nascent toner particles and may be an inorganic cationic coagulant, such as, for example, polyaluminum chloride (PAC), polyaluminum sulfosilicate (PASS), aluminum sulfate, zinc sulfate, magnesium sulfate, chlorides of magnesium, calcium, zinc, beryllium, aluminum, sodium, other metal halides including monovalent and divalent halides and so on.

The aggregating factor may be present in any suitable or desired amount. In embodiments, the aggregating factor may be present an emulsion in an amount of from about 0 to about 10 percent by weight, or from about 0.05 to about 5 percent by weight, based on the total solids in the toner.

The toner can further comprises one or more additives. The toner particles can be mixed with one or more of silicon dioxide or silica ($SiO_2$), titania or titanium dioxide ($TiO_2$) and/or cerium oxide, among other additives. Silica may be a first silica and a second silica. The second silica may have a larger average size (diameter) than the first silica. The first silica may have an average primary particle size, measured in diameter, in the range of from about 5 nm to about 50 nm. The second silica may have an average primary particle size, measured in diameter, in the range of from about 100 nm to about 200 nm. The titania may have an average primary particle size in the range of from about 5 nm to about 50 nm. The cerium oxide may have an average primary particle size in the range of, for example, about 5 nm to about 50 nm.

Zinc stearate also may be used as an external additive. Calcium stearate and magnesium stearate may provide similar functions. Zinc stearate may have an average primary particle size of from about 500 nm to about 700 nm.

The toner particles may be prepared by any method within the purview of one skilled in the art, for example, any of the emulsion aggregation methods can be used with a polyester resin. However, any suitable method of preparing toner particles may be used, including chemical processes, such as, suspension and encapsulation processes disclosed, for example, in U.S. Pat. Nos. 5,290,654 and 5,302,486, the disclosure of each of which herein is incorporated by reference in entirety; by conventional granulation methods, such as, jet milling, pelletizing slabs of material, other mechanical processes, any process for producing nanoparticles or microparticles, and so on. In embodiments, the toners herein are emulsion aggregation toners.

In embodiments relating to an emulsion aggregation process, a resin, for example, made as described above, can be dissolved in a solvent, and can be mixed into an emulsion medium, for example water, such as, deionized water (DIW), optionally containing a stabilizer, and optionally a surfactant. Examples of suitable stabilizers include water-soluble alkali metal hydroxides, such as, sodium hydroxide, potassium hydroxide, lithium hydroxide, beryllium hydroxide, magnesium hydroxide, calcium hydroxide or barium hydroxide; ammonium hydroxide; alkali metal carbonates, such as, sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. When a stabilizer is used, the stabilizer can be present in any suitable or desired amount, in embodiments in amounts of from about 0.1% to about 5% by weight of the resin. The stabilizer can be added to the mixture at ambient temperature or can be heated to the mixture temperature prior to addition.

In embodiments, the toners herein are prepared using latexes of one or more of the toner components. In certain embodiments, a phase inversion emulsification process is used to prepare one or more of the toner components which latexes are then used in the emulsion aggregation process.

In embodiments, a solvent-free emulsification process for preparing polyester latex comprising contacting a polyester with a solid neutralizing agent in the absence of an organic solvent to form a pre-blend mixture; melt mixing the mixture; contacting the melt mixed mixture with deionized water to form an oil in water emulsion; and optionally, recovering polyester latex particles is employed. For further detail, see U.S. Pat. No. 9,822,217, which is hereby incorporated by reference herein in its entirety.

In embodiments, an emulsification process is used to prepare the amorphous sustainable polyester resin latex, the crystalline polyester latex, and the styrene acrylate latex. Use of phase inversion emulsification processes to prepare the latexes used in the emulsion aggregation process enables a lower cost toner process over current known processes and in combination with the use of the present sustainable amorphous polyester, selected crystalline polyester, in embodiments, C10:C4 crystalline polyester, and styrene acrylate copolymer, enables a lower cost toner that provides the desired toner characteristics previously only attainable at higher cost. The present toner combination and process results in savings over previous comparable toners of from about U.S. 0.35 to about 1 or more per kilogram of resin. This cost savings is achieved while also providing a largely bio-based resin that, in embodiments, contains about 20 percent or more bio-based materials, such as rosin monomer, and that is, in embodiments, free of bisphenol A.

In certain embodiments, use of the present amorphous sustainable resin, in embodiments in an amount of from about 5 to about 45 percent by weight based upon the total weight of the toner, in combination with a selected amount of rosin monomer in the amorphous polyester resin, as described herein, in combination with a compatible crystalline resin, in embodiments a C10:C4 crystalline resin, in further combination with styrene acrylate copolymer as described herein, achieves a toner providing comparable charging, blocking, and fusing performance to prior emulsion aggregation toners but at significantly reduced cost.

Following emulsification, toner compositions may be prepared by aggregating a mixture of at least one amorphous polyester resin, a crystalline resin, a colorant, an optional wax, and any other desired additives in an emulsion, optionally, with surfactants as described above, and then optionally coalescing the aggregated particles in the mixture. A mixture may be prepared by adding an optional wax or other materials, which optionally also may be in a dispersion, including a surfactant, to the emulsion comprising the resins, colorant, optional wax, and optional biocide(s). The ph of the resulting mixture may be adjusted with an acid, such as, for example, acetic acid, nitric acid or the like. In embodiments, the ph of the mixture may be adjusted to from about 2 to about 4.5.

Additionally, in embodiments, the mixture may be homogenized at any suitable or desired speed, in embodiments at a speed of from about 20,000 to about 74,000 rpm. Homogenization may be by any suitable means, including, for example, an IKA ULTRA TURRAX T50 probe homogenizer.

During homogenization, an aggregating agent may be added to the mixture to facilitate the process. Any suitable aggregating agent may be utilized to form a toner. Suitable aggregating factors or coagulant include, for example, aqueous solutions of a divalent cation, a multivalent cation or a compound comprising same.

The particles may be permitted to aggregate until a predetermined desired particle size is attained. Particle size can be monitored during the growth process, for example, with a COULTER COUNTER, for average particle size. Aggregation thus may proceed by maintaining the mixture, for example, at an elevated temperature, or slowly raising the temperature, for example, from about 34° C. to about 99° C., and holding the mixture at that temperature from about 0.5 hour to about 6 hours, while maintaining stirring, to provide the desired aggregated particles.

Once the desired size of the toner particles or aggregates is achieved, the ph of the mixture may be adjusted with base or buffer to a value of from about 5 to about 10. The adjustment of ph may be used to freeze, that is, to stop, toner particle growth. The base used to stop toner particle growth may be, for example, an alkali metal hydroxide, such as, sodium hydroxide, potassium hydroxide, ammonium hydroxide, and the like, and combinations thereof.

In embodiments, a chelating agent may be introduced after aggregation is complete to contribute to the freezing ph adjustment.

The aggregate particles may be of a volume average particle size of less than about 8 micrometers (μm), such as from about 2 μm to about 7 μm, but sizes outside of those ranges can be used.

After aggregation, but prior to coalescence, a resin coating may be applied to the aggregated particles to form a shell thereover. A shell can comprise any resin described herein, or as known in the art. In embodiments, a polyester amorphous resin latex as described herein may be included in a shell, which may be combined with a different resin, and then added to the particles as a resin coating to form a shell. In embodiments, the shell comprises a styrene acrylate copolymer and a wax. In other embodiments, the shell comprises a styrene acrylate copolymer.

A shell resin may be applied to the aggregated particles by any method within the purview of those skilled in the art. A resin or other emulsion may be combined with the aggregated particles so that a shell forms over the aggregated particles.

Formation of a shell over aggregated particles may occur while heating, such as to a temperature from about 30° C. to about 50° C. Formation of a shell may take place in any suitable or desired period of time, such as for a period of time from about 5 minutes to about 10 hours.

A shell may be present in any suitable or desired amount, in embodiments, in an amount from about 1% by weight to about 80% by weight of the toner particle.

Following aggregation to a desired particle size and application of any optional shell, the particles then may be coalesced to a desired final shape, such as, a circular shape, for example, to correct for irregularities in shape and size. Coalescence can be achieved by, for example, heating the mixture to a temperature from about 50° C. to about 99° C., which may be at or above the Tg of the resins used to form the toner particles, and/or reducing the stirring, for example, from about 1000 to about 100 rpm. Coalescence may be conducted over a period from about 0.5 to about 9 hours, until the circularity as measured by Sysmex Flow Particle Image Analysis (FPIA) 2100 is >0.950. In embodiments, the toner circularity is of from about 0.950 to about 1, or from about 0.960 to about 0.990, or from about 0.970 to about 0.985.

For further detail, see, for example, U.S. Pat. No. 7,736,831, which is hereby incorporated by reference herein in its entirety.

After coalescence, the mixture may be cooled to room temperature, such as, from about 20° C. to about 25° C. Cooling may be rapid or slow, as desired. A suitable cooling method may include introducing cold water in a jacket around a reactor. After cooling, the toner particles optionally may be washed with water and then dried. Drying may be accomplished by any suitable method for drying including, for example, freeze drying.

In embodiments a toner process herein comprises contacting an amorphous polyester resin; a crystalline polyester resin; a styrene acrylate copolymer; an optional wax; an optional colorant; and an optional aggregating agent; wherein the amorphous polyester resin comprises a rosin monomer content of from about 10 to about 25 percent rosin monomer based upon the total amount of monomer comprising the amorphous polyester resin; heating to form aggregated toner particles; optionally, adding a shell resin to the aggregated toner particles, and heating to a further elevated temperature to coalesce the particles; and recovering the toner particles. In certain embodiments, at least one of the amorphous polyester resin, the crystalline resin, the styrene acrylate copolymer, or a combination thereof, are provided in the form of a latex prepared by phase inversion emulsification.

The toner particles also may contain optional additives.

The toner may include any known charge additives in any suitable or desired amount, such as in amounts of from about 0.1 to about 10 weight % of the toner. Examples of such charge additives include alkyl pyridinium halides, bisulfates, the charge control additives of U.S. Pat. Nos. 3,944,493; 4,007,293; 4,079,014; 4,394,430; and 4,560,635, the disclosure of each of which herein is incorporated by reference in entirety, negative charge enhancing additives, such as, aluminum complexes, and the like.

Charge enhancing molecules can be used to impart either a positive or a negative charge on a toner particle. Examples include quaternary ammonium compounds, see, for example, U.S. Pat. No. 4,298,672, organic sulfate and sulfonate compounds, see for example, U.S. Pat. No. 4,338,390, the disclosure of each of which herein is incorporated by reference in entirety, cetyl pyridinium tetrafluoroborates, distearyl dimethyl ammonium methyl sulfate, aluminum salts and so on.

Surface additives can be added to the toner compositions, for example, after washing or drying. Examples of such surface additives include, for example, one or more of a metal salt, a metal salt of a fatty acid, a colloidal silica, a metal oxide, such as, $TiO_2$ (for example, for improved relative humidity (RH) stability, tribo control and improved development and transfer stability), an aluminum oxide, a cerium oxide, a strontium titanate, $SiO_2$, mixtures thereof and the like. Examples of such additives include those disclosed in U.S. Pat. Nos. 3,590,000; 3,720,617; 3,655,374; and 3,983,045, the disclosure of each of which is hereby incorporated by reference herein in entirety.

Such additives may be included in any suitable or desired amount, such as in an amount of from about 0.1 to about 10 percent by weight of the toner particle.

Other surface additives include lubricants, such as, a metal salt of a fatty acid (e.g., zinc or calcium stearate) or long chain alcohols, such as, UNILIN™ 700 available from Baker Petrolite and AEROSIL R972® available from Degussa. Coated silicas of U.S. Pat. Nos. 6,190,815 and 6,004,714, the disclosure of each of which is hereby incorporated by reference herein in entirety, also can be present. Such additives can be included in any suitable or desired amount, such as in an amount of from about 0.05 to about 5% by weight of the toner particle, which additives can be added during aggregation or blended into a formed toner product.

Toners may possess suitable charge characteristics when exposed to extreme RH conditions. The low humidity zone (C zone) may be about 10° C. and 15% RH, while the high humidity zone (A zone) may be about 28° C. and 85% RH.

In embodiments, toners of the instant disclosure also may possess a parent toner charge per mass ratio (q/m) of from about −5 μC/g to about −90 μC/g, and a final toner charge after surface additive blending of from about −15 μC/g to about −80 μC/g.

Gloss of a toner may be influenced by amount of retained metal ion, such as, $Al^{3+}$, in a particle. Amount of retained metal ion may be adjusted by addition of a chelator, such as, EDTA. Amount of retained metal ion, for example, $Al^{3+}$, in toner particles of the present disclosure may be, in embodiments, from about 0.001 pph to about 1 pph. In embodiments, the gloss level of a toner of the instant disclosure may have a gloss, as measured by Gardner device, of from about 20 gloss units (gu) to about 100 gu.

Other desirable characteristics of a toner include storage stability, particle size integrity, high rate of fusing to the substrate or receiving member, sufficient release of the image from the photoreceptor, nondocument offset, use of smaller-sized particles and so on, and such characteristics can be obtained by including suitable reagents, suitable additives or both, and/or preparing the toner with particular protocols.

The characteristics of the toner particles may be determined by any suitable technique and apparatus. Volume average particle diameter and geometric standard deviation may be measured using an instrument, such as, a Beckman Coulter MULTISIZER 3, operated in accordance with the instructions of the manufacturer.

In embodiments, dry toner particles, exclusive of external additives, may have the following characteristics: (1) volume average diameter (also referred to as "volume average particle diameter") of from about 2.5 to about 20 μm; (2) number average geometric standard deviation (GSDn) and/or volume average geometric standard deviation (GSDv) of from about 1.18 to about 1.30; and (3) circularity of from about 0.9 to about 1.0 (measured with, for example, a Sysmex FPIA 2100 analyzer).

The toner particles thus formed may be formulated into a developer composition. For example, the toner particles may be mixed with carrier particles to achieve a two component developer composition. In embodiments, the toner concentration in the developer may be from about 1% to about 25% by weight of the total weight of the developer, with the remainder of the developer composition being the carrier. However, different toner and carrier percentages may be used to achieve a developer composition with desired characteristics.

Examples of carrier particles for mixing with the toner particles include those particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like.

The carrier particles may include a core with a coating thereover, which may be formed from a polymer or a mixture of polymers that are not in close proximity thereto in the triboelectric series, such as, those as taught herein or as known in the art. The coating may include fluoropolymers. The coating may have a coating weight of, for example, from about 0.1 to about 5% by weight of the carrier.

Various effective suitable means can be used to apply a polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt or to fuse to the carrier core. The coated carrier particles then may be cooled and thereafter classified to a desired particle size.

Toners and developers can be combined with a number of devices ranging from enclosures or vessels, such as, a vial, a bottle, a flexible container, such as a bag or a package, and so on, to devices that serve more than a storage function, such as, a toner delivery device, such as, a cartridge, for forming an image. Blocking performance can be manifest as storage stability as a finely divided powder.

The toners or developers can be used for electrostatographic or electrophotographic processes. Any known type of image development system may be used in an image developing device, including, for example, magnetic brush development, jumping single component development, hybrid scavengeless development (HSD) and the like. Those and similar development systems are within the purview of those skilled in the art.

Imaging processes include, for example, preparing an image with an electrophotographic device including, for example, one or more of a charging component, an imaging component, a photoconductive component, a developing component, a transfer component, a fusing component and so on. The device may include a high speed printer, a color printer and the like.

Once the image is formed with toners/developers via a suitable image development method, such as any of the aforementioned methods, the image then may be transferred to an image receiving medium or substrate, such as, a paper and the like. In embodiments, the fusing member or component, which can be of any desired or suitable configuration, such as, a drum, a roller, a belt, a web, a flat surface, a platen or the like, may be used to set the toner image on the substrate. MFT is a consideration as the minimum temperature needed to affix images comprising toner on a substrate. Blocking performance can be a consideration as the temperature which can result in unintended transfer of a fixed or fused image or parts thereof from a substrate carrying the image to another substrate.

Color printers commonly use four housings carrying different colors to generate full color images based on black plus the standard printing colors, cyan, magenta and yellow. In embodiments, additional housings may be desirable, including image generating devices possessing five housings, six housings or more, thereby providing the ability to carry additional toner colors to print an extended range of colors (extended gamut).

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Toner samples can be evaluated, such as by conditioning toner, or developer samples overnight in selected zones, such as A, B, and J zones and then charged using a Turbula mixer for about 60 minutes. The A zone is a high humidity zone at about 80° F. and 80% relative humidity (RH) and the J zone is a low humidity zone at about 70° F. and about 10% RH. B Zone is an ambient condition zone of about 50% RH at about 70° F. Toner charge (Q/d) can be measured using a charge spectrograph with a 100 V/cm field, and can be measured visually as the midpoint of the toner charge distribution. The toner charge per mass ratio (Q/m) can be determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/m ratio.

A first amorphous sustainable resin having about 16.9 percent rosin monomer was prepared.

A second amorphous sustainable resin having about 17.5 percent rosin was.

Control Example 1

Preparation of cyan Control toner with 2 shells. In a 2 Liter glass kettle, 92.5 grams of amorphous low Mw polyester resin emulsion (40% solids), 92.5 grams of amorphous high Mw polyester resin emulsion (40% solids), 33.6 grams crystalline polyester emulsion (CPE C10:6), 7.5 grams wax (30% solids), 50.2 grams cyan pigment (17% solids), and 490 grams deionized (DI) water are combined. The slurry is ph adjusted to 3.0 using 0.3M nitric acid. Then 2.69 grams of aluminum sulphate ($AlSO_4$) mixed with 31 grams DI water is added to the slurry under homogenization at 4000-5000 RPM. The reactor is set to 270 RPM and is heated to 48° C. to aggregate the toner particles. When the size reaches 4.7-4.9 micrometers (μm), a shell coating is added which consists of 32.5 grams of both amorphous low Mw and high Mw polyester resin emulsion, 12.54 grams wax and all pH adjusted to 3 using 0.3M Nitric acid. When the size reaches 5.2-5.4 μm, a second shell coating is added which consists of 32.5 grams of both amorphous low Mw and high Mw polyester resin emulsion and all pH adjusted to 3 using 0.3M Nitric acid. The reactor is further heated to 50° C. When the toner particle size reaches 5.8-6.0 microns, freezing begins with the pH of the slurry being adjusted to 4.5 using a 4% NaOH solution. The reactor RPM is decreased to 240 followed by the addition of 5.77 grams of a chelating agent (Versene™ 100) and more NaOH solution until pH reaches 7.8. The reactor temperature is ramped to 70° C. The pH of the slurry is maintained at 7.8 or greater until 68° C. Once at 70° C., the slurry pH is reduced to 5.8 using ph 5.7 Buffer then further ph adjusted to 3.3 with 0.3M nitric acid. The reactor is held at 70° C. for another 20 minutes then further heated to 85° C. Once at the coalescence temperature of 85° C., the slurry is coalesced for about 300 minutes where the particle circularity is between 0.967-0.975 as measured by the Flow Particle Image Analysis (FPIA) instrument. The slurry is then quench cooled in 360 grams DI ice. The final particle size was 5.8 microns, GSDv 1.22, GSDn 1.24 and a circularity of 0.977. The toner is then washed and freeze-dried.

Example 2

Preparation of cyan hyper-pigmented chimeric toner with 2 shells. In a 2 Liter glass kettle, 61 grams of amorphous sustainable resin emulsion (16.9% rosin), 82 grams of amorphous sustainable resin emulsion (17.5% rosin), 40 grams crystalline polyester emulsion (CPE C10:4), 16.4 grams wax, 61 grams cyan pigment, 33 grams emulsion aggregation styrene/n-butyl acrylate latex and 410 grams deionized (DI) water are combined. The slurry is ph adjusted to 3.0 using 0.3M nitric acid. Then 2.2 grams of polyaluminum chloride (PAC) mixed with 27 grams DI water is added to the slurry under homogenization at 4000-5000 RPM. The reactor is set to 270 RPM and is heated to 48° C. to aggregate the toner particles. When the size reaches 4.7-4.9 micrometers (μm), a shell coating is added which consists of 42 grams of emulsion aggregation styrene/n-butyl acrylate latex, 8.2 grams wax and all pH adjusted to 3 using 4% sodium hydroxide (NaOH). When the size reaches 5.2-5.4 μm, a second shell coating is added which consists of 42 g of emulsion aggregation styrene/n-butyl acrylate latex and all pH adjusted to 3 using 4% sodium hydroxide (NaOH). The reactor is further heated to 50° C. When the toner particle size reaches 5.8-6.0 microns, freezing begins with the pH of the slurry being adjusted to 4.5 using a 4% NaOH solution. The reactor RPM is decreased to 240 followed by the addition of 4.62 grams of a chelating agent (Versene™ 100) and more NaOH solution until pH reaches 7.8. The reactor temperature is ramped to 70° C. The pH of the slurry is maintained at 7.8 or greater until 68° C. Once at 70° C., the slurry pH is reduced to 5.8 using ph 5.7 Buffer then further ph adjusted to 3.3 with 0.3M nitric acid. The reactor is held at 70° C. for another 20 minutes then further heated to 85° C. Once at the coalescence temperature of 85° C., the slurry is coalesced for 300 minutes where the particle circularity is between 0.967-0.975 as measured by the Flow Particle Image Analysis (FPIA) instrument. The slurry is then quench cooled in 360 grams DI ice. The final particle size was 5.65 microns, GSDv 1.22, GSDn 1.23 and a circularity of 0.970. The toner is then washed and freeze-dried.

Example 3

Preparation of cyan hyper-pigmented chimeric toner with 1 shell. In a 2 Liter glass kettle, 60 grams of amorphous sustainable resin emulsion (16.9% rosin), 80 grams of amorphous sustainable resin emulsion (17.5% rosin), 57 grams crystalline polyester emulsion (CPE C10:4), 28.7 grams wax, 61 grams cyan pigment, 33 grams emulsion aggregation styrene/n-butyl acrylate latex and 405 grams DI water are combined. The slurry is pH adjusted to 3.0 using 0.3M nitric acid. Then 2.2 grams of polyaluminum chloride (PAC) mixed with 27 grams DI water is added to the slurry under homogenization at 4000-5000 RPM. The reactor is set to 270 RPM and is heated to 48° C. to aggregate the toner particles. When the size reaches 4.9-5.2 μm, a shell coating is added which consists of 84 grams of emulsion aggregation styrene/n-butyl acrylate latex that is pH adjusted to 3 using 4% sodium hydroxide (NaOH). When the toner particle size reaches 5.8-6.0 microns, freezing begins with the pH of the slurry being adjusted to 4.5 using a 4% NaOH solution. The reactor RPM is decreased to 240 followed by the addition of 4.62 grams of a chelating agent (Versene™ 100) and more NaOH solution until pH reaches 7.8. The reactor temperature is ramped to 70° C. The pH of the slurry is maintained at 7.8 or greater until 68° C. Once at 70° C., the slurry pH is reduced to 5.8 using pH 5.7 Buffer then further pH adjusted to 3.3 with 0.3M nitric acid. The reactor is held at 70° C. for another 20 minutes then further heated to 85° C. Once at the coalescence temperature of 75° C., the slurry is coalesced for about 200 minutes where the particle circularity is between 0.967-0.975 as measured by the Flow Particle Image Analysis (FPIA) instrument. The slurry is then quench cooled in 360 grams DI ice. The final particle size was 5.65 microns, GSDv 1.22, GSDn 1.23 and a circularity of 0.976. The toner is then washed and freeze-dried.

Toner charging performance is shown in Table 1.

TABLE 1

| | Example 1-Control | Example 2 | Example 3 |
|---|---|---|---|
| A Zone add Q/d | 7.3 | 6.7 | 6.5 |
| A Zone add Q/m | 30.5 | 38.4 | 32.4 |
| A Zone 2' Q/m | 49.4 | 60.0 | 51.6 |
| J Zone add Q/d | 16.6 | 15.5 | 18.1 |
| J Zone add Q/m | 74.8 | 101.1 | 78.0 |
| 24 Hour Charge Maintenance % | 91 | 85.3 | 95.0 |
| 7 Day Charge Maintenance % | 76 | 66.7 | 68.0 |
| Parent A Zone 10' Q/d | 3.9 | 3.8 | 5.0 |
| Parent A Zone 10' Q/m | 14.6 | 20.5 | 22.3 |
| Parent J Zone 10' Q/d | 15.0 | 17.5 | 20.7 |
| Parent J Zone 10' Q/m | 67.2 | 109.2 | 106.7 |
| Blocking Onset Temperature (° C.) | 53.6 | 52.4 | 52.7 |

As shown in Table 1, overall charging for Example 2 and Example 3 is comparable to Control Example 1 and can be adjusted to match.

Fusing data is shown in Table 2 and Table 3.

TABLE 2

| | Control Example 1 | Example 3 |
|---|---|---|
| Fuser | Pinot 308 mm/s | Pinot 308 mm/s |
| Cold Offset on CX+ | 141 | 131 |
| Gloss at MFT on Bold | 39 | 43 |
| Gloss at 185° C. on Bold | 67 | 62 |
| Peak Gloss on Bold | 68 | 62 |
| T(Gloss 40) on Bold | 140 | 137 |
| T(Gloss 50) on Bold | 152 | 149 |
| T(Gloss 60) on Bold | 166 | 170 |
| $MFT_{CA-80}$ (Extrapolated MFT) | 139 | 141 |
| ΔMFT | −16/0 | −14/+2 |
| Mottle/Hot Offset | 206/206 | 211/>221 |
| Fusing Latitude | 65/65 | 70/>80 |
| ΔFix ($T_{G50}$ & $MFT_{CA-80}$) | −19/0 | −22/−3 |
| Fracture Coefficient | 2.26 | 2.73 |

TABLE 3

| | Control Example 1 | Example 2 |
|---|---|---|
| Fuser | Pinot 308 mm/s | Pinot 308 mm/s |
| Cold Offset on CX+ | 138 | 134 |
| Gloss at MFT on Bold | 37 | 40 |
| Gloss at 185° C. on Bold | 67 | 60 |
| Peak Gloss on Bold | 71 | 69 |
| T(Gloss 40) on Bold | 141 | 139 |
| T(Gloss 50) on Bold | 153 | 150 |
| $MFT_{CA-80}$ (Extrapolated MFT) | 138 | 139 |
| ΔMFT | −18/0 | 17/+1 |
| Mottle/Hot Offset | >221/>221 | 216/>221 |
| Fusing Latitude | >83/>83 | 77/>82 |
| ΔFix ($T_{G50}$ & $MFT_{CA-80}$) | −17/0 | −20/−3 |
| Fracture Coefficient | 2.35 | 2.67 |

Fusing data shows that the toner of the present embodiments including the lower cost non-bisphenol A toner compositions, provide results comparable to the control toner Example 1. Samples were fused with a Xerox® fusing fixture with a hyper-pigmented TMA (toner mass per unit area) of 0.8.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A toner composition comprising:

an amorphous polyester resin;

a crystalline polyester resin, wherein the crystalline polyester resin comprises an acid monomer comprising at least one methylene group and an alcohol monomer comprising at least one methylene group, wherein said acid and alcohol monomers together comprise 14 or fewer methylene groups;

a styrene acrylate copolymer;

an optional wax; and an optional colorant;

wherein the amorphous polyester resin comprises a rosin monomer content of from about 10 to about 25 percent rosin monomer based upon the total amount of monomer comprising the amorphous polyester resin.

2. The toner composition of claim 1, wherein the amorphous polyester resin comprises a rosin monomer content of from about 15 to about 20 percent rosin monomer based upon the total amount of monomer comprising the amorphous polyester resin.

3. The toner composition of claim 1, wherein the rosin monomer content of the amorphous polyester resin comprises a mixture of a rosin-diol, a bis-rosin alcohol and a rosin-carbonate.

4. The toner composition of claim 1, wherein the rosin monomer content of the amorphous polyester resin comprises at least one of rosin adducts I-V prepared by the reaction scheme

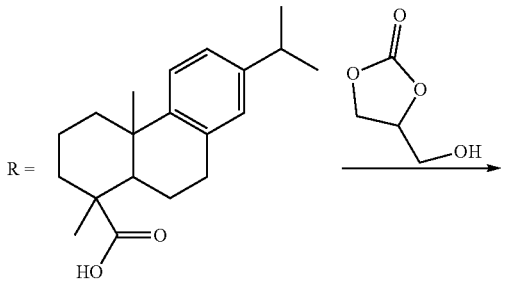

-continued

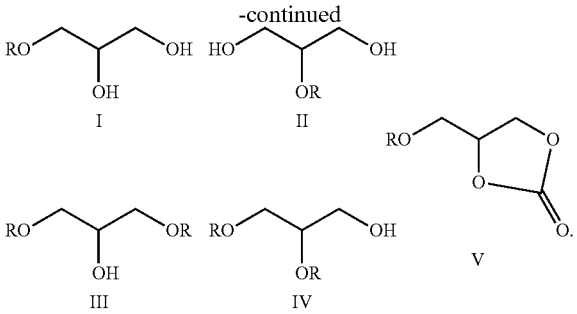

5. The toner composition of claim 1, wherein the toner composition is free of bisphenol A.

6. The toner composition of claim 1, wherein the amorphous polyester resin is present in an amount of from about 20 to about 60 percent by weight based on the total weight of the toner composition;

wherein the crystalline polyester resin is present in an amount of from about 5 to about 20 percent by weight based on the total weight of the toner composition; and wherein the styrene acrylate copolymer is present in an amount of from about 10 to about 40 percent by weight based on the total weight of the toner composition.

7. The toner composition of claim 1, wherein the crystalline polyester resin comprises a C10:C4 resin.

8. The toner composition of claim 1, wherein the styrene acrylate copolymer is styrene butyl acrylate.

9. The toner composition of claim 1, wherein one or more of the toner components is prepared using a phase inversion emulsification process.

10. The toner composition of claim 1, wherein the toner comprises a hyper-pigmented toner.

11. A toner composition comprising:

a core;

at least one shell disposed thereover;

wherein the core comprises at least one amorphous polyester resin, at least one crystalline polyester resin, wherein the crystalline polyester resin comprises an acid monomer comprising at least one methylene group and an alcohol monomer comprising at least one methylene group, wherein said acid and alcohol monomers together comprise 14 or fewer methylene groups; at least one styrene acrylate copolymer, an optional wax, and an optional colorant;

wherein the shell comprises at least one styrene acrylate copolymer and an optional wax; and wherein the amorphous polyester resin comprises a rosin monomer content of from about 10 to about 25 percent rosin monomer based upon the total amount of monomer comprising the amorphous polyester resin.

12. The toner composition of claim 11, wherein the toner comprises a first shell and a second shell.

13. The toner composition of claim 11, wherein the amorphous polyester resin comprises a rosin monomer content of from about 15 to about 20 percent rosin monomer based upon the total amount of monomer comprising the amorphous polyester resin.

14. The toner composition of claim 11, wherein the toner composition is free of bisphenol A.

15. The toner composition of claim 11, wherein the amorphous polyester resin is present in an amount of from about 35 to about 45 percent by weight based on the total weight of the toner composition;

wherein the crystalline polyester resin is present in an amount of from about 5 to about 12 percent by weight based on the total weight of the toner composition; and wherein the styrene acrylate copolymer is present in an amount of from about 25 to about 30 percent by weight based on the total weight of the toner composition.

16. The toner composition of claim 11, wherein the crystalline polyester resin comprises a C10:C4 resin.

17. A toner process comprising:

contacting an amorphous polyester resin; a crystalline polyester resin wherein the crystalline polyester resin comprises an acid monomer comprising at least one methylene group and an alcohol monomer comprising at least one methylene group, wherein said acid and alcohol monomers together comprise 14 or fewer methylene groups; a styrene acrylate copolymer; an optional wax; an optional colorant; and an optional aggregating agent;

wherein the amorphous polyester resin comprises a rosin monomer content of from about 10 to about 25 percent rosin monomer based upon the total amount of monomer comprising the amorphous polyester resin;

heating to form aggregated toner particles;

optionally, adding a shell resin to the aggregated toner particles, and heating to a further elevated temperature to coalesce the particles; and recovering the toner particles.

18. The process of claim 17, wherein the toner composition is free of bisphenol-A.

19. The process of claim 17, wherein at least one of the amorphous polyester resin; the crystalline polyester resin; the styrene acrylate copolymer, or a combination thereof, are provided in the form of a latex prepared by phase inversion emulsification.

* * * * *